US008333074B2

(12) United States Patent
KaKovitch

(10) Patent No.: US 8,333,074 B2
(45) Date of Patent: Dec. 18, 2012

(54) METHOD AND APPARATUS FOR INCORPORATING A LOW PRESSURE FLUID INTO A HIGH PRESSURE FLUID, AND INCREASING THE EFFICIENCY OF THE RANKINE CYCLE IN A POWER PLANT

(76) Inventor: Thomas KaKovitch, Herndon, VA (US)

( * ) Notice: Subject to any disclaimer, the term of this patent is extended or adjusted under 35 U.S.C. 154(b) by 817 days.

(21) Appl. No.: 12/507,838

(22) Filed: Jul. 23, 2009

(65) Prior Publication Data

US 2010/0018206 A1 Jan. 28, 2010

Related U.S. Application Data

(60) Provisional application No. 61/083,527, filed on Jul. 25, 2008.

(51) Int. Cl.
*F01K 25/06* (2006.01)
*F04B 23/08* (2006.01)

(52) U.S. Cl. ..... 60/649; 60/651; 60/671; 366/101; 366/107

(58) Field of Classification Search ..... 60/649, 60/651, 671; 366/101, 107, 137.1, 177.1, 366/181.6
See application file for complete search history.

(56) References Cited

U.S. PATENT DOCUMENTS

| | | | | | |
|---|---|---|---|---|---|
| 4,756,624 | A * | 7/1988 | Hoppe et al. | ..... | 366/101 |
| 5,248,197 | A * | 9/1993 | Storf et al. | ..... | 366/341 |
| 5,255,519 | A * | 10/1993 | Kakovitch | ..... | 60/649 |
| 5,793,831 | A * | 8/1998 | Tsiklauri et al. | ..... | 376/317 |
| 5,810,564 | A * | 9/1998 | Kakovitch | ..... | 417/207 |
| 6,358,015 | B1 * | 3/2002 | Kakovitch | ..... | 417/84 |
| 7,387,427 | B2 * | 6/2008 | Chiang et al. | ..... | 366/102 |
| 7,677,046 | B2 * | 3/2010 | Althaus et al. | ..... | 60/778 |

* cited by examiner

*Primary Examiner* — Hoang Nguyen
(74) *Attorney, Agent, or Firm* — Dennison, Schultz & MacDonald

(57) ABSTRACT

A mixing device for incorporating a light gas at low pressure into a working fluid at a very high pressure includes a mixing section in the form of a truncated conical section between the an inlet and an outlet, a plurality of inlets for the light gas into the mixing section, and a plurality of passages through the truncated conical section into a cylindrical section leading to the outlet.

11 Claims, 4 Drawing Sheets

FIG. 3
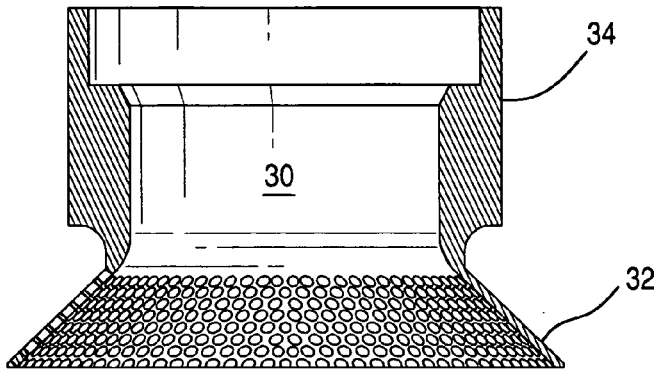
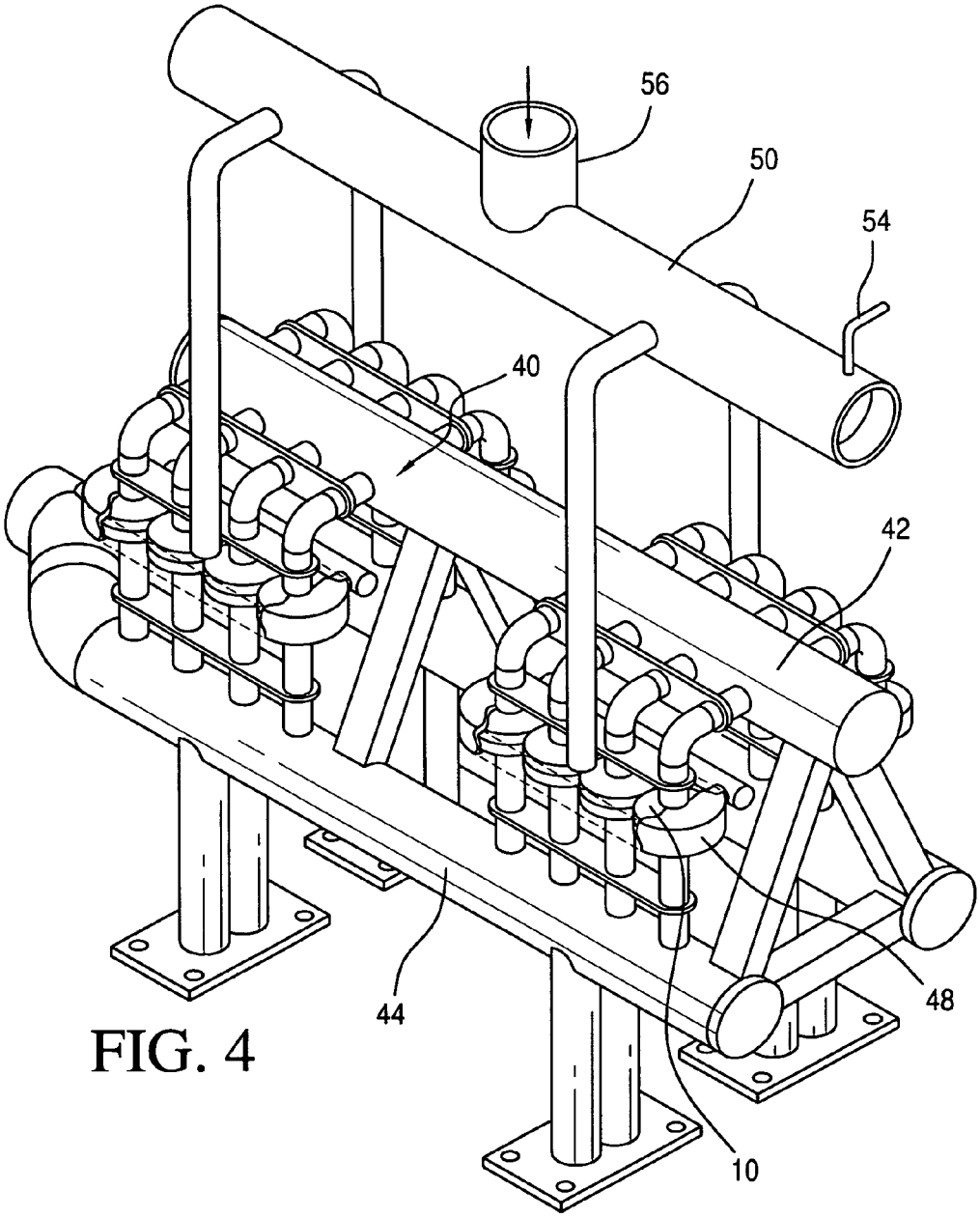
FIG. 4

METHOD AND APPARATUS FOR INCORPORATING A LOW PRESSURE FLUID INTO A HIGH PRESSURE FLUID, AND INCREASING THE EFFICIENCY OF THE RANKINE CYCLE IN A POWER PLANT

This application claims the benefit of U.S. Provisional Application 61/083,527 filed Jul. 25, 2008.

BACKGROUND OF THE INVENTION

The invention relates to the field of mixing fluids, where one fluid is at a very low pressure and one fluid is at a very high pressure, and to use such fluid mixing to increase the megawatt output of a steam power plant, with a reduction of fuel consumption, by incorporating a newly modified mechanical system that is able to evacuate gas from very low pressures, and to recompress the gas to very high pressures.

In my U.S. Pat. Nos. 5,255,519 and 5,444,981 (incorporated herein by reference), I proposed increasing the efficiency in the generation of power, particularly electric power, using the Rankine cycle, by incorporating a light gas in the working fluid to increase the compressibility of the working fluid, and hence the expansion of the fluid in the cycle. In the closed system disclosed in those patents, a light, condensable gas, typically helium, is added to a working fluid, typically water, in a boiler. The working fluid is vaporized in the boiler, and the mixture of light gas and vaporized working fluid is used to operate a turbine to generate electric power. The light gas and working fluid mixture is then passed to a condenser to separate the working fluid from the light condensable gas, and the gas and working fluid are separately returned to the boiler. I refer to this system for increasing efficiency of the Rankine cycle as the "KaKovitch Cycle."

The addition of the light gas to the system creates a thermodynamic cycle parallel to the Rankine cycle, using the light gas as the working fluid, in contrast to the Rankine cycle, which uses steam as the working fluid. The two cycles are integrated to jointly convert heat energy to mechanical energy with greater efficiency. The combination of steam and helium creates a working fluid of increased compressibility factor-Z.

The amount of usable energy in an power plant using the Rankine cycle is defined primarily by enthalpy. The difference between ideal and actual enthalpy of the system is tied to the residual enthalpy of that system (enthalpy departure). The combination of the parallel Rankine and helium cycles into a new combined cycle substantially increases the amount of work done by the new working fluid, as compared with steam alone, for the same amount of fuel consumed. This decrease in the consumption of fuel has the added benefit of reduction of the emission of greenhouse gases creates eligibility for carbon credit programs.

The parallel helium cycle can be retrofitted into an existing power plant, or incorporated into the design of new power plants. In either case, it is required that a light gas at a very low pressure be incorporated into a working fluid at a very high pressure.

In the combined helium-steam cycle, a portion of the light gas may be returned to the boiler by way of aspiration by the working fluid or may be returned separately. Additionally, a compressor may be used to return the light gas to the boiler at high pressure.

In my U.S. Pat. No. 5,810,564 (incorporated herein by reference), I proposed the use of an apparatus described as a "vortex pump" to evacuate helium from the condenser and to return the separated helium to the boiler. Because the helium is returned to the boiler, however, the efficiency of the mixing of the helium with the working fluid is limited. Greater efficiency would be expected by mixing the helium with the compressed working fluid before heating in the boiler, but this presents problems, since the compressed working fluid is at a very high pressure, possibly in the range of 2000-4000 psig, while the helium is at a very low pressure, which makes mixing difficult.

Another such device for mixing fluids is disclosed in my U.S. Pat. No. 6,358,015, also incorporated herein by reference.

SUMMARY OF THE INVENTION

It is therefore an object of the invention to provide an apparatus to mix together fluids at vastly different pressures.

It is also an object of the invention to increase the efficiency of a power generation cycle by mixing a light fluid into the working fluid which has been compressed and is at a very high pressure.

To achieve these and other objects, the invention is directed to a mixing device comprising:

a first inlet for a working fluid comprising a pipe having a first diameter;

an outlet for light gas and working fluid comprising a pipe having a second diameter which is smaller than the first diameter;

a mixing section interposed between the first inlet and the outlet, the first inlet, the outlet and the mixing section being connected to form a through passage from the first inlet to the outlet, the mixing section comprising:

a cylindrical section of external diameter greater than the diameter of the pipe of the first diameter;

a truncated conical section between the pipe of first diameter and the cylindrical section, and having an outer surface of diameter decreasing from the cylindrical section to the pipe of first diameter, and an inner surface of diameter which increases from the cylindrical section to the pipe of first diameter;

a plurality of passages through the truncated conical section into the cylindrical section; and a multiplicity of small holes disposed between the passages and the through passage in the cylindrical section.

The invention is also directed to a skid with a plurality of said mixing devices with inlets and outlets connected in parallel, for incorporation of a large amount of light fluid into a large amount of working fluid.

The invention is further directed to a power generation system including a boiler, turbine/generator, condenser and high-pressure pump, in which light fluid is removed from the boiler, and recycled by injection into high pressure working fluid in the boiler, typically using a plurality of said mixing devices connected in parallel.

The helium cycle which operates in parallel with the Rankine cycle can be retrofitted into an existing power plant by calculating the expected overall thermodynamic increase in efficiency, using data obtained from the Rankine cycle's heat balance. This apparatus according to the invention is able to evacuate helium from the boiler, and recompress the helium back into the boiler.

The compression of the helium generates heat, which is absorbed by the high pressure feed water, and reduces the power necessary to heat the water in the reservoir.

The lack of moving parts in the mixing device minimizes stress tension on the apparatus, which is designed to withstand up to 4000 psia pressure.

Multiple mixing devices connected in parallel are placed on a skid with inlet and outlet manifolds, based on the parameters of a power plant. The stress analysis of the apparatus dictates the material and thickness of the material used in the mixing devices, typically stainless steel.

BRIEF DESCRIPTION OF THE DRAWINGS

FIG. 3 is a perspective view of the separator of the mixing device;

FIG. 4 is a perspective view of a plurality of mixing devices connected in parallel;

DESCRIPTION OF THE PREFERRED EMBODIMENTS

Figure 1:
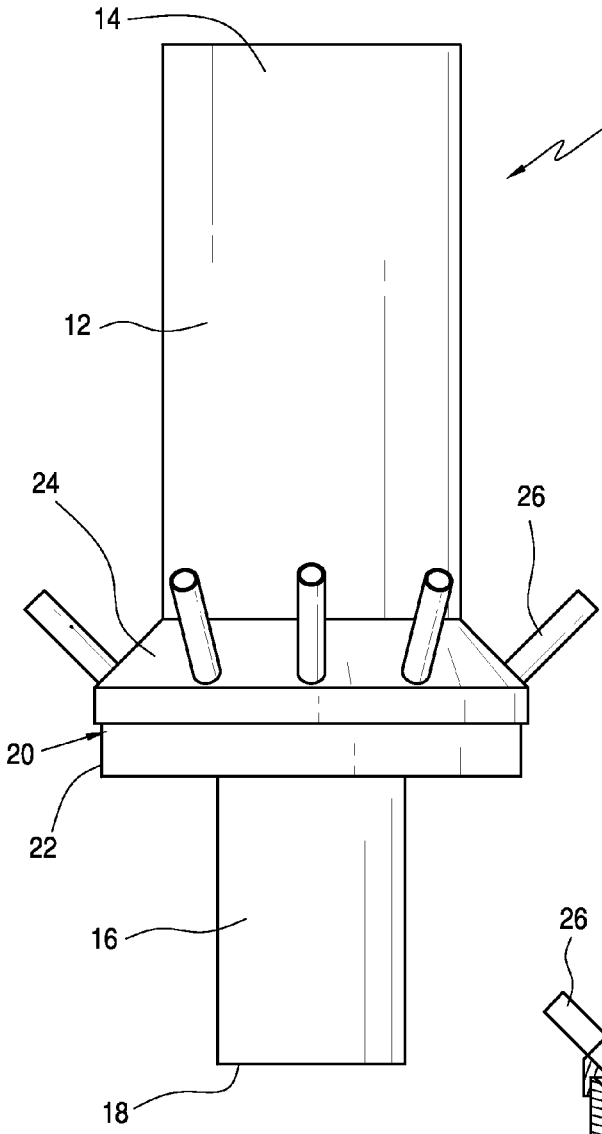
FIG. 1 is a perspective view of the mixing device of the invention.

FIG. 1 shows the basic elements of the mixing device of the invention 10, including an inlet pipe 12 with an inlet 14 for working fluid, an outlet pipe 16 with an outlet 18 for mixed fluids, and a mixing section 20 having a cylindrical section 22 and a truncated conical section 24 with a plurality of inlets 26 for the light fluid to be mixed. The inlets 26 are disposed at an angle of about 30-60°, preferably 45°. There are preferably 8 inlets, although that number may vary, for example, between 4 and 10.

Figure 2:
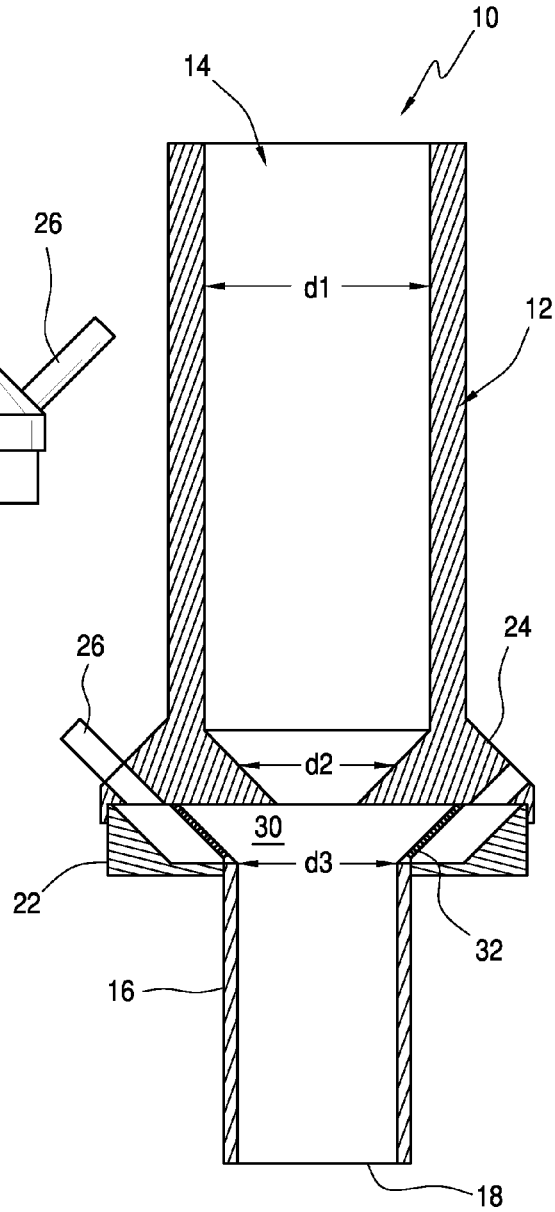
FIG. 2 is a cross-sectional view of the mixing device of the invention.

The same elements can be seen in FIG. 2, along with the interior configuration of the device. The inlet pipe 12 has a first diameter d1 which narrows within the truncated conical section 24 to a diameter d2. The cylindrical portion has a greater diameter which narrows in a similar manner to a diameter d3, which is less than d1, and which is the diameter of outlet pipe 16.

Within the cylindrical section is a mixer 30, shown in detail in FIG. 3. The mixer 30 has a truncated conical portion 32 with walls covered with small holes, in the range of 0.05-0.1" in diameter, typically 0.062". In the example shown in FIG. 3, there are 9 rows of holes, with 90 holes in the largest row, and decreasing numbers in the subsequent rows of lesser diameter, the smallest row containing 55 holes, all equally spaced. The truncated conical section leads into a straight section 34, which leads into the outlet pipe.

FIG. 4 shows a skid 40 containing a plurality of mixing devices 10 connected in parallel, the plurality having substantially greater mixing capacity than an individual device. In the typical configuration shown, there are sixteen mixing devices, in four groups of four, the devices connected using a common inlet manifold 42 which is open at a proximal end and closed at a distal end. There are a pair of outlet manifolds 44, each one connected to eight mixing devices on one side of the skid, the manifolds 44 closed at the proximal end and open at the distal end, where the outlet manifolds are joined. Each mixing device is connected between the inlet manifold and an outlet manifold. In order to improve safety at very high pressures of operation, the mixing devices are shown disposed within a stainless steel cover 48.

Figure 5:
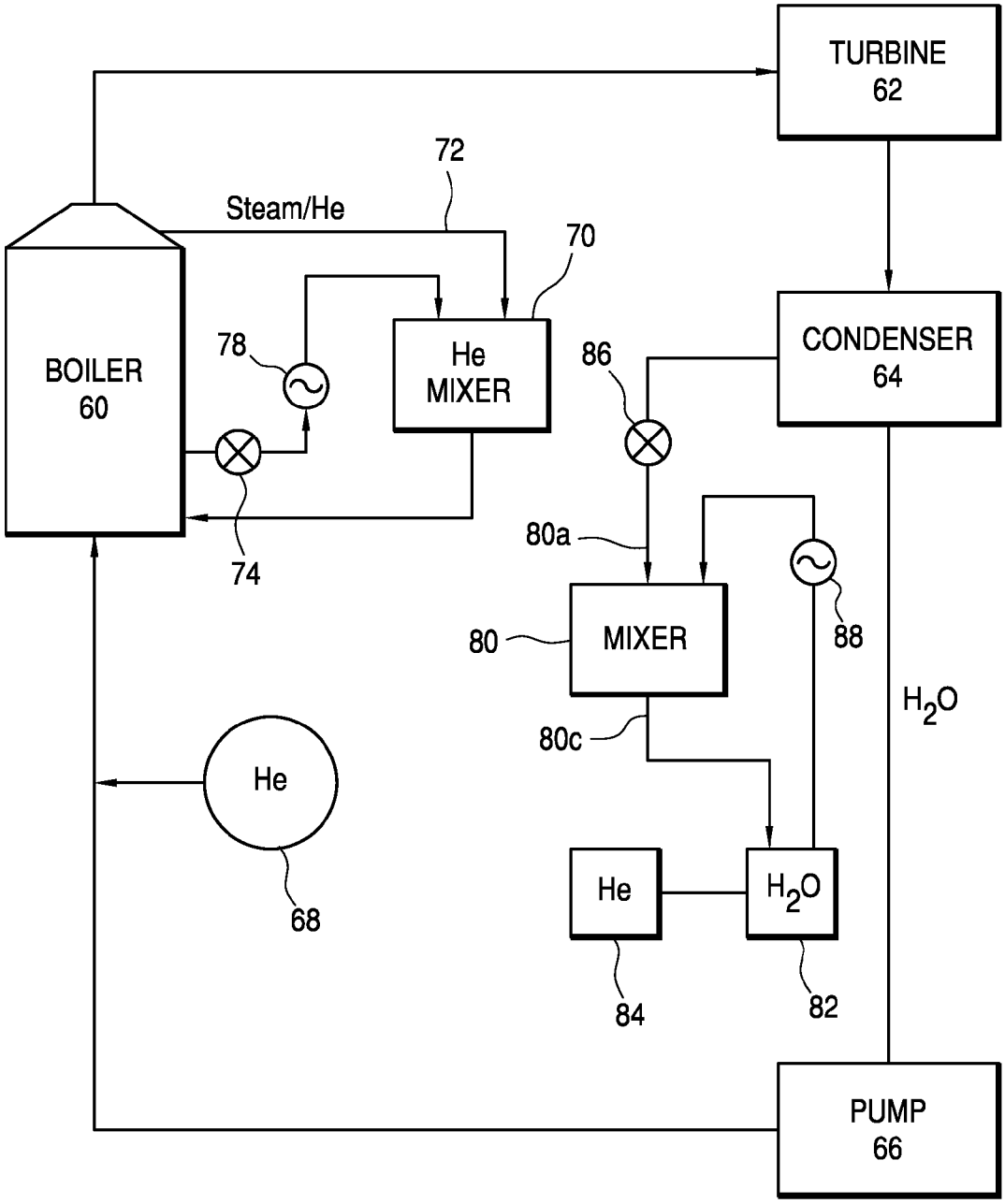
FIG. 5 is a schematic diagram of the a power generation system using the mixing device of the invention.

Helium is supplied to mixers 10 through a helium manifold 50, which receives recycled helium from a condenser through a line 52, as is described with respect to FIG. 5. Fresh helium may be added to the system through valve 54.

FIG. 5 schematically shows a power generation system including a boiler 60 connected to a turbine 62, condenser 64, and high-pressure pump 66. These are the typical elements of the system. In order to improve the efficiency of this system, as disclosed in U.S. Pat. No. 5,255,519, a light gas, in this case helium, is provided for injection into the system from a source 68.

Figure 6:
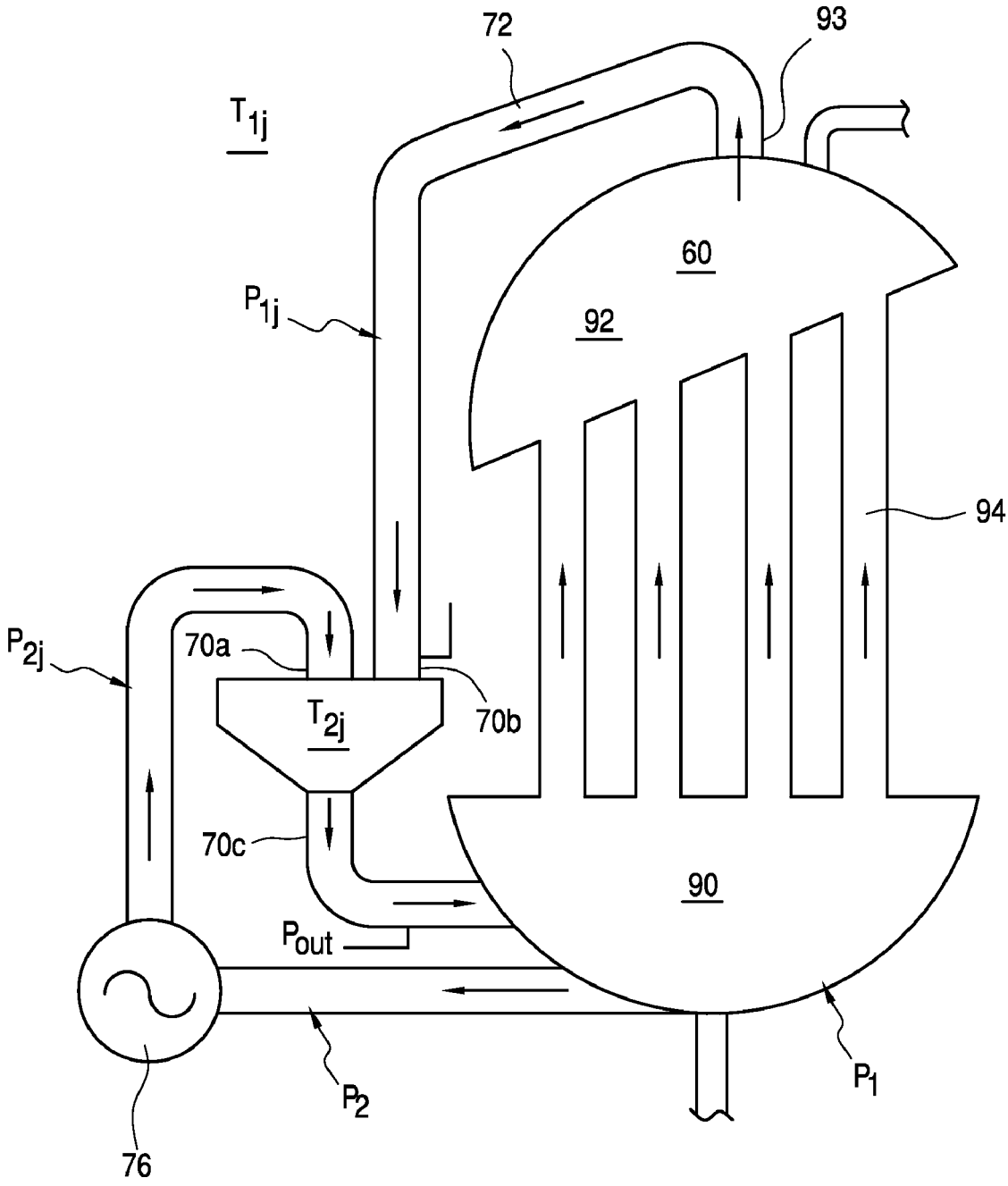
FIG. 6 is a schematic diagram of a boiler showing the recycling of helium.

In order to better mix the helium with the working fluid, a plurality 70 of mixing devices in parallel are provided, as shown in FIG. 4, in order to recycle steam/helium from the safety valve of the boiler, as shown in greater detail in FIG. 6. As shown in FIG. 6, the boiler includes a water drum 90 and steam drum 92 connected by water tubes 94. The steam drum is equipped with a safety valve 93.

According to the invention, water is removed from feed water drum 90 of the boiler through valve 74, and pump 76 passes the water to the water inlet 70*a* of mixing device 70. Steam/helium are removed from the steam drum 92 of the boiler through safety valve 93, and passed to the gas inlet 70*b* of mixing device 70. Water containing the recycled helium is passed from the outlet 70*c* of mixing device 70 back to the water drum of boiler 60.

Systems such as that shown in FIG. 5 must be shut down on a regular basis, potentially resulting in a loss of helium. In order to collect helium from the system, an additional mixing device according to the invention can be provided to remove helium from the system, and under certain circumstance, air from the system.

Thus, FIG. 5 shows an additional mixing valve 80 having a gas inlet 80*a* connected to the condenser. A water reservoir 82 is provided, connected between the water inlet 80*b* of the mixing device and the outlet 80*c*. A helium reservoir 84 is connected to the water reservoir 82. When valve 86 is opened and pump 88 is started, water is pumped through the mixing device 80, creating a vacuum which removes helium from the condenser, the helium passing from the water reservoir to the helium reservoir. The helium may be used as a helium source when the system is restarted.

It may also be desirable to use mixer 80 and the associated water circuit to remove air from the system.

EXAMPLE

The mixing device of the invention (FIG. 4) is used to recycle steam from the steam drum of a boiler to the water drum, in a circuit as shown in FIGS. 5 and 6, with turbine and compressor. The following measurements were made:

$P_1$=1000 psi
$P_2$=923 psi
$P_{2j}$=78.026 psi increase over $P_2$
$P_{1j}$=14.7 psi
$T_{1j}$(ambient temperature)=520° R (460+60° F.)
water flow=200 gpm
$P_{out}$=14.7 psi
$T_{2j}$=840.269° (temperature of compressed air)

The work done on the turbine due to air compression was calculated at 8.9839 hp.

What is claimed is:

1. A mixing device comprising:

a first inlet for a working fluid comprising a pipe having a first diameter;

an outlet for light gas and working fluid comprising a pipe having a second diameter which is smaller than the first diameter;

a mixing section interposed between the first inlet and the outlet, the first inlet, the outlet and the mixing section being connected to form a through passage from the first inlet to the outlet, the mixing section comprising:

a cylindrical section of external diameter greater than the diameter of the pipe of the first diameter;

a truncated conical section between the pipe of first diameter and the cylindrical section, and having an outer surface of diameter decreasing from the cylindrical section to the pipe of first diameter, and an inner surface of diameter which increases from the cylindrical section to the pipe of first diameter;

a plurality of passages through the truncated conical section into the cylindrical section; and a multiplicity of small holes disposed between the passages and the through passage in the cylindrical section.

2. The apparatus of claim 1, wherein the passages are disposed at an angle of 30-60° to horizontal.

3. The apparatus of claim 1, wherein 4-10 passages are disposed through the truncated conical section.

4. An apparatus for mixing a light fluid at low pressure with a heavier fluid at a higher pressure comprising:

a plurality of mixing devices, each said mixing device comprising:

a first inlet for a working fluid comprising a pipe having a first diameter;

an outlet for light gas and working fluid comprising a pipe having a second diameter which is smaller than the first diameter;

a mixing section interposed between the first inlet and the outlet, the first inlet, the outlet and the mixing section being connected to form a through passage from the first inlet to the outlet, the mixing section comprising:

a cylindrical section of external diameter greater than the diameter of the pipe of the first diameter;

a truncated conical section between the pipe of first diameter and the cylindrical section, and having an outer surface of diameter decreasing from the cylindrical section to the pipe of first diameter, and an inner surface of diameter which increases from the cylindrical section to the pipe of first diameter;

a plurality of passages through the truncated conical section into the cylindrical section; and a multiplicity of small holes disposed between the passages and the through passage in the cylindrical section;

at least one inlet manifold, to which each said first inlet is connected; and at least one outlet manifold, to which each said outlet is connected.

5. A mixing apparatus of claim 4, comprising a pair of outlet manifolds, each said outlet being connected to one manifold of said pair.

6. The mixing apparatus of claim 5, comprising sixteen said mixing devices in two parallel rows of eight each, with the eight mixing devices in a row being connected to a single said outlet manifold.

7. The mixing apparatus of claim 4, additionally comprising a cover encasing a plurality of said mixing devices.

8. In an apparatus for converting heat energy to mechanical energy, comprising:

a boiler for containing a working fluid, the boiler comprising a liquid drum, a gas drum, a plurality of tubes connecting the liquid drum and the gas drum, and a heating device for heating working fluid in the liquid drum;

a light gas source in fluid connection with said boiler;

means for expanding the working fluid in vapor form and converting a portion of the energy therein to mechanical work, in fluid connection with the gas drum;

condenser means for condensing expanded working fluid in vapor form, in fluid connection with said means for expanding; and a pump for returning cooled, condensed working fluid to the reservoir at an increased pressure;

the improvement wherein the apparatus additionally comprises:

a mixing device having a liquid inlet connected to the liquid drum, an outlet connected to the liquid drum and a gas inlet connected to the gas drum, for recycling a portion of light gas in the gas drum to the liquid drum, the mixing device comprising:

a first inlet for a working fluid comprising a pipe having a first diameter;

an outlet for light gas and working fluid comprising a pipe having a second diameter which is smaller than the first diameter;

a mixing section interposed between the first inlet and the outlet, the first inlet, the outlet and the mixing section being connected to form a through passage from the first inlet to the outlet, the mixing section comprising:

a cylindrical section of external diameter greater than the diameter of the pipe of the first diameter;

a truncated conical section between the pipe of first diameter and the cylindrical section, and having an outer surface of diameter decreasing from the cylindrical section to the pipe of first diameter, and an inner surface of diameter which increases from the cylindrical section to the pipe of first diameter;

a plurality of passages through the truncated conical section into the cylindrical section; and a multiplicity of small holes disposed between the passages and the through passage in the cylindrical section.

9. The apparatus according to claim 8, wherein a plurality of said mixing devices are connected in parallel.

10. The apparatus according to claim 8, additionally comprising a pump for passing liquid from the liquid drum to the mixing device.

11. In an apparatus for converting heat energy to mechanical energy, comprising:

a boiler for containing a working fluid, the boiler comprising a liquid drum, a gas drum, a plurality of tubes connecting the liquid drum and the gas drum, and a heating device for heating working fluid in the liquid drum;

means for expanding the working fluid in vapor form and converting a portion of the energy therein to mechanical work, in fluid connection with the gas drum;

condenser means for condensing expanded working fluid in vapor form, in fluid connection with said means for expanding; and a pump for returning cooled, condensed working fluid to the reservoir at an increased pressure;

the improvement wherein the apparatus additionally comprises:

a mixing device, a fluid reservoir and a gas reservoir, the mixing device having a gas inlet in fluid connection with the condenser, a liquid inlet in fluid connection with the liquid reservoir and an outlet in fluid connection with the liquid reservoir, the gas reservoir being in fluid connection with the liquid reservoir for receiving gas removed by the mixing device from the condenser to the liquid reservoir, the mixing device comprising:

a first inlet for a working fluid comprising a pipe having a first diameter;

an outlet for light gas and working fluid comprising a pipe having a second diameter which is smaller than the first diameter;

a mixing section interposed between the first inlet and the outlet, the first inlet, the outlet and the mixing section being connected to form a through passage from the first inlet to the outlet, the mixing section comprising:

a cylindrical section of external diameter greater than the diameter of the pipe of the first diameter;

a truncated conical section between the pipe of first diameter and the cylindrical section, and having an outer surface of diameter decreasing from the cylindrical section to the pipe of first diameter, and an inner surface of diameter which increases from the cylindrical section to the pipe of first diameter;

a plurality of passages through the truncated conical section into the cylindrical section; and a multiplicity of small holes disposed between the passages and the through passage in the cylindrical section.

* * * * *